US009245731B2

(12) United States Patent
Inada et al.

(10) Patent No.: US 9,245,731 B2
(45) Date of Patent: Jan. 26, 2016

(54) LIGHT IRRADIATING APPARATUS

(71) Applicant: USHIO DENKI KABUSHIKI KAISHA, Tokyo (JP)

(72) Inventors: Tadashi Inada, Hyogo (JP); Kenji Yamamori, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/680,643

(22) Filed: Apr. 7, 2015

(65) Prior Publication Data

US 2015/0287586 A1 Oct. 8, 2015

(30) Foreign Application Priority Data

Apr. 8, 2014 (JP) ..... 2014-079090

(51) Int. Cl.

| | |
|---|---|
| ***H01J 7/26*** | (2006.01) |
| ***H01J 61/52*** | (2006.01) |
| ***H05B 41/36*** | (2006.01) |
| ***H05B 41/24*** | (2006.01) |

(52) U.S. Cl.

CPC ..... *H01J 61/526* (2013.01); *H05B 41/24* (2013.01); *H05B 41/36* (2013.01)

(58) Field of Classification Search

USPC ..... 313/35, 607, 618, 631, 632; 315/118, 315/362

See application file for complete search history.

(56) References Cited

U.S. PATENT DOCUMENTS

| | | | | |
|---|---|---|---|---|
| 4,101,424 | A * | 7/1978 | Schooley | B41F 23/0409 250/492.1 |
| 5,198,717 | A | 3/1993 | Kogelschatz et al. | |
| 5,834,784 | A * | 11/1998 | Morgan | A61L 2/10 250/435 |
| 6,201,355 | B1 * | 3/2001 | Morgan | C02F 1/325 250/436 |
| 6,570,301 | B1 * | 5/2003 | Hishinuma | H01J 65/046 313/25 |
| 6,633,109 | B2 * | 10/2003 | Falkenstein | A61L 2/10 313/163 |
| 8,834,789 | B2 * | 9/2014 | Schiene | C02F 1/325 422/22 |

FOREIGN PATENT DOCUMENTS

JP H04-301357 A 10/1992

* cited by examiner

*Primary Examiner* — Thuy Vinh Tran

(74) *Attorney, Agent, or Firm* — Michael Best & Friedrich LLP

(57) ABSTRACT

A light irradiating apparatus includes: an excimer lamp including a high voltage side electrode and a low voltage side electrode; a cooling mechanism configured to cool the high voltage side electrode using a cooling medium; and a leak current discharge circuit. The cooling mechanism includes a passage and a conductor, in which the passage allows the cooling medium to flow through, and the conductor is in contact with the cooling medium, and the conductor is electrically connected to the leak current discharge circuit.

6 Claims, 5 Drawing Sheets

LIGHT IRRADIATING APPARATUS

CROSS REFERENCE TO RELATED APPLICATIONS

This application claims the benefit of Japanese Priority Patent Application JP2014-079090 filed on Apr. 8, 2014, the entire contents of which are incorporated herein by reference.

BACKGROUND

The invention relates to a light irradiating apparatus provided with an excimer lamp including a high voltage side electrode configured to be cooled by a cooling medium such as pure water.

A manufacturing process of, for example, a semiconductor device or a liquid crystal panel involves optical ashing treatment of a resist or dry cleaning treatment with respect to a glass substrate or a silicon wafer. Also, a nanoimprint method entails optical ashing treatment of a resist adhering to a patterned surface of a template. Furthermore, in a manufacturing process of a printed circuit board, wiring board materials are subjected to desmear treatment or surface roughening treatment of an insulating layer.

In such treatment, a light irradiating apparatus provided with an excimer lamp has been used. Moreover, for example, in desmear treatment of wiring board materials, a large-output light irradiating apparatus has been desired, seeking for shortened treatment time.

In such a large-output light irradiating apparatus, when an excimer lamp is lit, temperature of the excimer lamp increases to a considerably high temperature, causing deterioration in luminous efficiency. Accordingly, cooling of the excimer lamp is desirable. Thus, Japanese Unexamined Patent Application Publication No. H04(1992)-301357 discloses a light irradiation apparatus in which a high voltage side electrode of the excimer lamp is cooled by allowing a cooling medium having low electric conductivity to be in direct contact with the high voltage side electrode. The cooling medium may be, for example, pure water or the like.

SUMMARY

However, the above-mentioned light irradiating apparatus has disadvantages as follows.

In a case of using pure water as the cooling medium, impurities such as metal ions may be mixed into the cooling medium due to deterioration or the like in the high voltage side electrode of the excimer lamp or in other metal components that are in contact with the cooling medium. This may cause a rise in the electric conductivity of the cooling medium. Accordingly, there may occur high voltage current leakage from the high voltage side electrode to the cooling medium, allowing a high voltage current to flow in a heat exchanger configured to cool the cooling medium. As a result, there is possibility of a failure of the heat exchanger or other appliances or the like that are connected to the heat exchanger.

One possible method to avoid such disadvantages may be to take measures for safety of the heat exchanger in case of occurrence of a high voltage current flowing from the high voltage side electrode of the excimer lamp. However, taking measures for safety of the heat exchanger involves an insulation structure in a heat exchange section of the heat exchanger. This leads to lowered accuracy in heat exchange, as well as an increase in heat exchanger cost due to special specifications, causing a disadvantage in practical use.

It is desirable to provide a light irradiating apparatus that makes it possible to cool the high voltage side electrode of the excimer lamp safely.

A light irradiating apparatus according to an embodiment of the invention includes: an excimer lamp including a high voltage side electrode and a low voltage side electrode; a cooling mechanism configured to cool the high voltage side electrode using a cooling medium; and a leak current discharge circuit. The cooling mechanism includes a passage and a conductor, in which the passage allows the cooling medium to flow through, and the conductor is in contact with the cooling medium. The conductor is electrically connected to the leak current discharge circuit.

In the light irradiating apparatus according to the above-described embodiment of the invention, preferably, part of the passage may be configured of the conductor. Moreover, preferably, the leak current discharge circuit may include a current detecting section configured to detect a leak current flowing in the leak current discharge circuit. In this case, preferably, there may be further included: a lamp lighting mechanism configured to turn on and turn off the excimer lamp; a power source configured to supply power to the lamp lighting mechanism; a switch configured to perform electrical connection and electrical disconnection of the lamp lighting mechanism and the power source; and a control section configured to control operation of the switch in response to the leak current detected by the current detecting section. Furthermore, preferably, the lamp lighting mechanism may include a first terminal and a second terminal, in which the first terminal is electrically connected to the high voltage side electrode, and the second terminal is connected to the low voltage side electrode, and the leak current discharge circuit may be connected to the second terminal. In addition, preferably, the passage may include a first passage section and a second passage section, in which the first passage section allows the cooling medium to flow toward the high voltage side electrode from the cooling mechanism, and the second passage section allows the cooling medium to flow toward the cooling mechanism from the high voltage side electrode, and the conductor may be provided in the second passage section.

According to the light irradiating apparatus in the above-described embodiment of the invention, the conductor that is in contact with the cooling medium to cool the high voltage side electrode of the excimer lamp is electrically connected to the leak current discharge circuit. Hence, it is possible to allow a current flowing to the cooling medium from the high voltage side electrode of the excimer lamp to be discharged to the outside through the conductor. Accordingly, it is possible to cool the high voltage side electrode of the excimer lamp safely.

It is to be understood that both the foregoing general description and the following detailed description are exemplary, and are intended to provide further explanation of the invention as claimed. Also, effects of the invention are not limited to those described above. Effects achieved by the invention may be those that are different from the above-described effects, or may include other effects in addition to those described above.

BRIEF DESCRIPTION OF THE DRAWINGS

The accompanying drawings are included to provide a further understanding of the invention, and are incorporated in and constitute a part of this specification. The drawings illustrate some example embodiments and, together with the specification, serve to explain the principles of the invention.

DETAILED DESCRIPTION

Some example embodiments of the invention are described in detail below with reference to the accompanying drawings.

Figure 1:
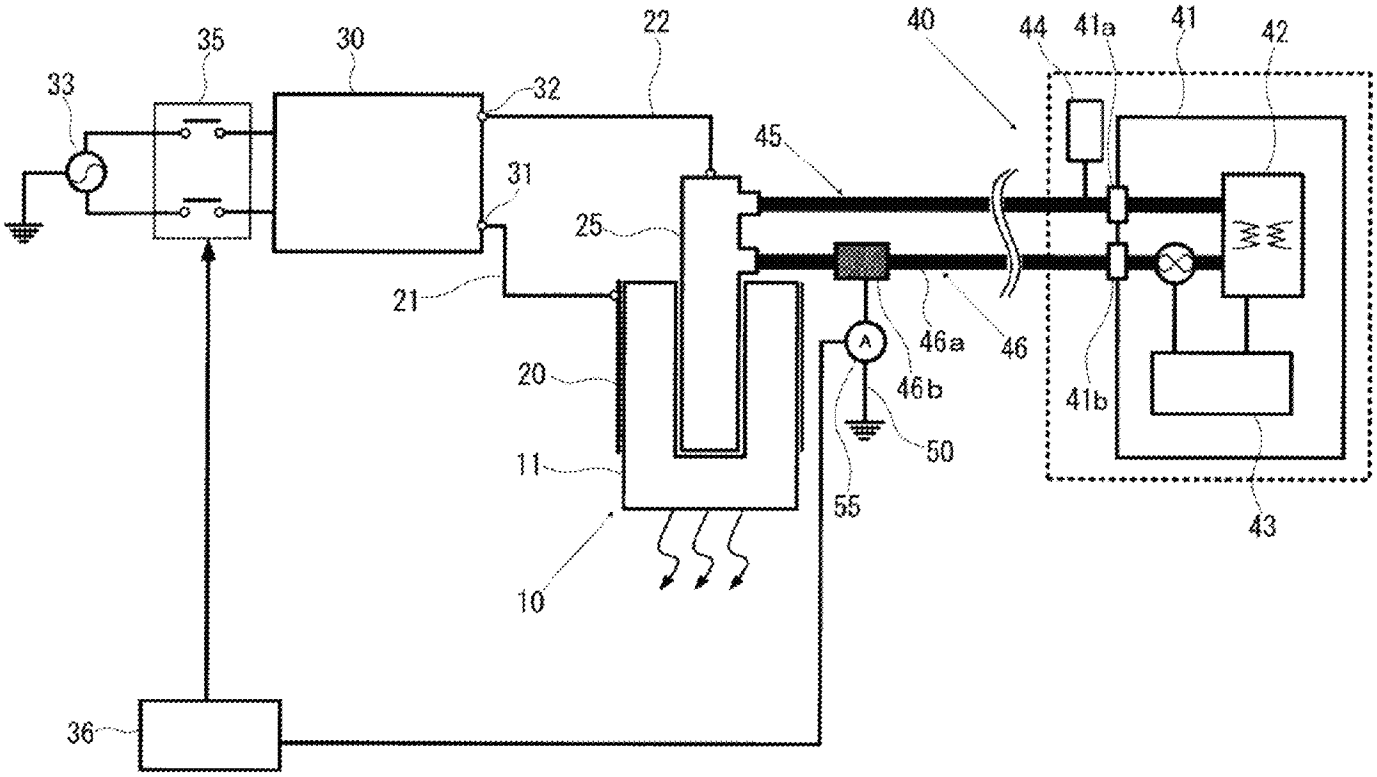
FIG. 1 is an explanatory diagram illustrating a configuration of an example of a light irradiating apparatus according to an example embodiment of the invention.

FIG. 1 is an explanatory diagram illustrating a configuration of an example of a light irradiating apparatus according to an example embodiment of the invention. The light irradiating apparatus may include an excimer lamp 10, a lamp lighting mechanism 30, and a cooling mechanism 40. The excimer lamp 10 includes a low voltage side electrode 20 and a high voltage side electrode 25. The lamp lighting mechanism 30 is configured to turn on the excimer lamp 10. The cooling mechanism 40 is configured to cool the high voltage side electrode 25 of the excimer lamp 10.

Figure 2:
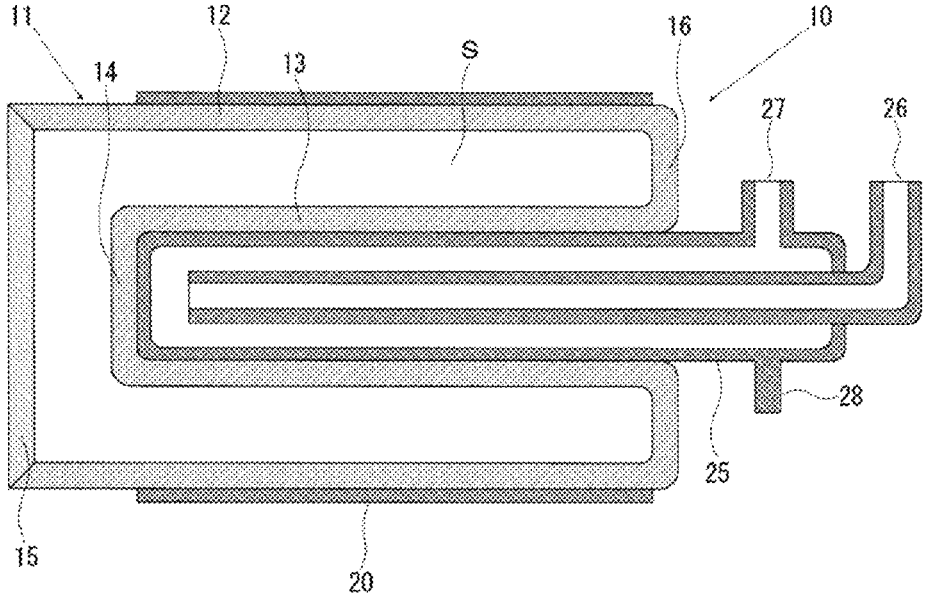
FIG. 2 is an explanatory cross-sectional view illustrating a configuration of an excimer lamp of the light irradiating apparatus illustrated in FIG. 1.

FIG. 2 is an explanatory cross-sectional view illustrating a configuration of the excimer lamp of the light irradiating apparatus illustrated in FIG. 1. The excimer lamp 10 may include a discharge vessel 11 having a double tube structure made of a dielectric. Specifically, the discharge vessel 11 may include an outer circumferential wall part 12 and an inner circumferential wall part 13. The outer circumferential wall part 12 may be of a circular tube shape. The inner circumferential wall part 13 may be of a circular tube shape having a smaller outer diameter than an inner diameter of the outer circumferential wall part 12, and may be disposed in the outer circumferential wall part 12 along its tubular axis. In an example shown, the outer circumferential wall part 12 may have a larger total length than a total length of the inner circumferential wall part 13. Moreover, the outer circumferential wall part 12 may be disposed so that a first end part (a left end part in FIG. 2) of the outer circumferential wall part 12 is protruded outwardly beyond a first end part (a left end part in FIG. 2) of the inner circumferential wall part 13.

A first end (a left end in FIG. 2) of the outer circumferential wall part 12 may be provided with a light takeout window 15 of a disk shape. The light takeout window 15 may be formed so as to close airtightly an opening of the first end of the outer circumferential wall part 12. A first end (a left end in FIG. 2) of the inner circumferential wall part 13 may be provided with a sealing wall part 14. The sealing wall part 14 may be formed so as to close airtightly an opening of the first end of the inner circumferential wall part 13. The second end parts of the outer circumferential wall part 12 and the inner circumferential wall part 13 may be joined airtightly by a sealing wall part 16.

Between the outer circumferential wall part 12 and the inner circumferential wall part 13, a discharge space S of a circular tube shape may be formed. A thickness (a distance between an inner circumferential surface of the outer circumferential wall part 12 and an outer circumferential surface of the inner circumferential wall part 13) of the discharge space S may be, for example, 3 mm to 20 mm both inclusive.

For a dielectric material that constitutes the discharge vessel 11, for example, synthetic fused silica may be used.

Examples of dimensions of the discharge vessel 11 may be as follows. The outer circumferential wall part 12 may have an outer diameter of 46 mm, the inner diameter of 40 mm (a thickness of 3 mm), and the total length of 120 mm. The inner circumferential wall part 13 may have the outer diameter of 16 mm, an inner diameter of 14 mm (a thickness of 1 mm), and the total length of 110 mm.

On an outer circumferential surface of the outer circumferential wall part 12 in the discharge vessel 11, the low voltage side electrode 20 may be provided. The low voltage side electrode 20 may be of a circular tube shape and may be disposed in close contact with the outer circumferential surface of the outer circumferential wall part 12. On an inner circumferential surface of the inner circumferential wall part 13 in the discharge vessel 11, the high voltage side electrode 25 may be provided. The high voltage side electrode 25 may be of a circular tube shape whose ends are both closed, and may be disposed in close contact with the inner circumferential surface of the inner circumferential wall part 13. The high voltage side electrode 25 may be provided with an inflow tube 26 and an outflow tube 27. The inflow tube 26 is adapted to allow a cooling medium to flow into a tube hole of the high voltage side electrode 25. The outflow tube 27 is adapted to allow the cooling medium to flow out of the tube hole. Moreover, on an outer circumferential surface of the high voltage side electrode 25, a connection terminal 28 may be provided so that the connection terminal 28 protrudes from the outer circumferential surface of the high voltage side electrode 25. The connection terminal 28 may be electrically connected to a high voltage side terminal 32 in the lamp lighting mechanism 30, which will be described later.

For a material that constitutes the low voltage side electrode 20 and the high voltage side electrode 25, a metal material such as, but not limited to, aluminum may be used.

In the discharge space S in the discharge vessel 11, a discharge gas may be sealed. For the discharge gas, a xenon gas, a mixture gas of argon and chlorine, or the like may be used. A sealing pressure of the discharge gas may be varied depending on the thickness of the discharge space S, and may be, for example, in a range from 35 kPa to 80 kPa both inclusive.

The lamp lighting mechanism 30 is configured to turn on the excimer lamp 10 by applying a high frequency voltage to the excimer lamp 10. The lamp lighting mechanism 30 may be provided with a low voltage side terminal 31 and the high voltage side terminal 32. The low voltage side electrode 20 of the excimer lamp 10 may be electrically connected to the low voltage side terminal 31 through a wiring 21. The high voltage side electrode 25 of the excimer lamp 10 may be electrically connected to the high voltage side terminal 32 through a wiring 22. Moreover, the lamp lighting mechanism 30 may be electrically connected to an alternating current power source 33 through a switch 35. A switch control section 36 configured to control the switch 35 may be electrically connected to the switch 35. The switch control section 36 is configured to control to open a contact of the switch 35 when a current detected by a current detecting section 55, which will be described later, becomes equal to or larger than a prescribed current value.

The cooling mechanism 40 is configured to cool the high voltage side electrode 25 by allowing the cooling medium to pass through the tube hole of the high voltage side electrode 25. The cooling mechanism 40 may include a heat exchanger 41 configured to control temperature of the cooling medium while the cooling medium is circulated. The heat exchanger 41 may include a heat exchange section 42 and a control section 43. The heat exchange section 42 is configured to cool the cooling medium. The control section 43 is configured to control the heat exchange section 42. Moreover, the heat exchanger 41 may be provided with a supply port 41*a* and an inlet port 41*b*. The supply port 41*a* is configured to allow the cooling medium to be supplied in. The inlet port 41*b* is configured to allow the cooling medium to be introduced into. Furthermore, the cooling mechanism 40 may be provided with a conductivity meter 44 configured to measure conductivity of the cooling medium supplied from the heat exchanger 41.

The supply port 41*a* in the heat exchanger 41 and the inflow tube 26 provided in the high voltage side electrode 25 may be connected by a cooling medium supply tube 45. In the cooling medium supply tube 45, a passage of the cooling medium supplied from the heat exchanger 41 to the high voltage side electrode 25 may be formed. The inlet port 41*b* in the heat exchanger 41 and the outflow tube 27 provided in the high voltage side electrode 25 may be connected by a cooling medium retrieval tube 46. In the cooling medium retrieval tube 46, a passage of the cooling medium retrieved from the high voltage side electrode 25 into the heat exchanger 41 may be formed.

For the cooling medium, pure water may be used.

The cooling medium supply tube 45 may be configured of an insulator. The cooling medium retrieval tube 46 may be configured of two insulating tube sections 46*a* and a conductive tube section 46*b*. The insulating tube sections 46*a* each may be configured of an insulator. The conductive tube section 46*b* may be disposed between the insulating tube sections 46*a* and may be configured of a conductor.

For the insulator that constitutes the cooling medium supply tube 45 and the insulating tube sections 46*a* in the cooling medium retrieval tube 46, resin materials such as, but not limited to, a vinyl chloride resin, a urethane resin, and a fluororesin, ceramic materials, or the like may be used.

For the conductor that constitutes the conductive tube section 46*b* in the cooling medium retrieval tube 46, nickel-plated iron, nickel-plated copper, or nickel-plated brass may be used.

The cooling medium supply tube 45, and the conductive tube section 46*b* and the insulating tube sections 46*a* in the cooling medium retrieval tube 46 each may have an inner diameter of, for example, 6 mm to 10 mm both inclusive.

Examples of dimensions of the conductive tube section 46*b* may be as follows: the inner diameter may be 6 mm, a total length may be 20 mm, and area of an inner surface (area in contact with the cooling medium) may be 376.8 $mm^2$ Alternatively, other examples of dimensions of the conductive tube section 46*b* may be as follows: the inner diameter may be 10 mm, the total length may be 20 mm, and the area of the inner surface (the area in contact with the cooling medium) may be 628 $mm^2$.

Figure 3A:
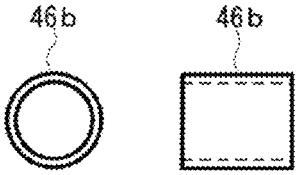
FIGS. 3A to 3E are explanatory diagrams illustrating internal configurations of a conductive tube section.
Figure 3B:
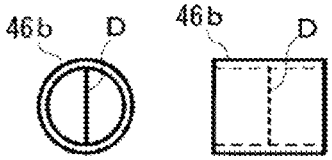
Figure 3C:
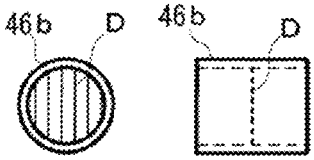
Figure 3D:
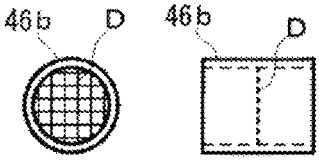
Figure 3E:
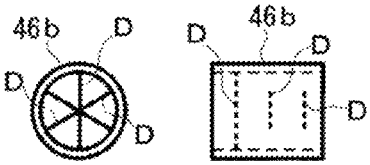

An inside of the conductive tube section 46*b* in the cooling medium retrieval tube 46 may be hollow, as illustrated in FIG. 3A. Alternatively, as illustrated in FIGS. 3B to 3E, a conductor line D may be disposed that is electrically connected to the conductive tube section 46*b*. Specifically, as illustrated in FIG. 3B, in the inside of the conductive tube section 46*b*, one conductor line D may be disposed that extends in a radial direction of the conductive tube section 46*b*. In another alternative, as illustrated in FIG. 3C, in the inside of the conductive tube section 46*b*, a plurality of conductor lines D may be disposed in stripes. Moreover, as illustrated in FIG. 3D, in the inside of the conductive tube section 46*b*, a plurality of conductor lines D may be disposed in a net shape. Furthermore, as illustrated in FIG. 3E, in the inside of the conductive tube section 46*b*, a plurality of conductor lines D may be disposed that each extend in the radial direction of the conductive tube section 46*b*. The plurality of conductor lines D may be spaced in an axial direction of the conductive tube section 46*b* and may be inclined with respect to one another.

A creepage distance between the high voltage side electrode 25 in the excimer lamp 10 and the conductive tube section 46*b* in the cooling medium retrieval tube 46 may be varied depending on a voltage to be applied between the low voltage side electrode 20 and the high voltage side electrode 25. In a case that an effective voltage value is 1 kV, the creepage distance may be equal to or larger than 16 mm. In a case that the effective voltage value is 4 kV, the creepage distance may be equal to or larger than 63 mm.

The conductive tube section 46*b* in the cooling medium retrieval tube 46 may be electrically connected to a leak current discharge circuit. In the example illustrated in FIG. 1, the leak current discharge circuit may be configured of a grounded wiring 50. Also in the example illustrated in FIG. 1, the leak current discharge circuit may be provided with the current detecting section 55 configured to detect a current flowing in the leak current discharge circuit. The current detecting section 55 may be electrically connected to the switch control section 36.

In the above-described light irradiating apparatus, a high frequency voltage is applied, by the lamp lighting mechanism 30, between the low voltage side electrode 20 and the high voltage side electrode 25 in the excimer lamp 10, allowing dielectric barrier discharge to occur in the discharge space S of the discharge vessel 11. This results in excimer generation in the discharge space S, allowing excimer light to be emitted through the light takeout window 15.

In the meanwhile, when the cooling mechanism 40 is operated, the cooling medium is supplied to the high voltage side electrode 25 from the heat exchange section 42 in the heat exchanger 41 through the cooling medium supply tube 45. Thus, the high voltage side electrode 25 is cooled by the cooling medium. After this, the cooling medium is introduced into the heat exchange section 42 in the heat exchanger 41 through the cooling medium retrieval tube 46, and is cooled in the heat exchange section 42.

When impurities such as metal ions are mixed into the cooling medium due to deterioration or the like in the high voltage side electrode 25 of the excimer lamp 10 or in other metal components that are in contact with the cooling medium, the electric conductivity of the cooling medium may rise, which may cause high voltage current leakage from the high voltage side electrode 25 to the cooling medium. This high voltage current flows, through the conductive tube section 46*b* in the cooling medium retrieval tube 46, into the leak current discharge circuit that may be configured of the grounded wiring 50, and is discharged to the outside.

Moreover, when the current detecting section 55 configured to detect the current flowing in the leak current discharge circuit detects a current that is equal to or larger than a prescribed current value, the contact of the switch 35 that is provided between the lamp lighting mechanism 30 and the alternating current power source 33 is opened by the switch control section 36. Thus, electrical connection between the lamp lighting mechanism 30 and the alternating current power source 33 is cut off. Consequently, lighting of the excimer lamp 10 is stopped.

In the foregoing, the voltage to be applied between the low voltage side electrode 20 and the high voltage side electrode 25 in the excimer lamp 10 may be, for example, 1 kV or more.

A flow rate of the cooling medium to be supplied to the high voltage side electrode 25 may be, for example, 1 L/min per one excimer lamp.

The prescribed current value to allow the contact of the switch 35 to be opened may be selected and set within a range of, for example, 10 mA to 50 mA both inclusive.

As described above, according to the above-described light irradiating apparatus, it is possible to discharge the high voltage current to the outside through the conductive tube section 46*b*, even in a case of the high voltage current leakage from the high voltage side electrode 25 to the cooling medium resulting from a rise of the electric conductivity of the cooling medium. Hence, it is possible to cool the high voltage side electrode 25 of the excimer lamp 10 safely.

Moreover, upon excessive current leakage to the cooling medium, the contact of the switch 35 provided between the lamp lighting mechanism 30 and the alternating current power source 33 is opened. This makes it possible to stop the lighting of the excimer lamp 10.

Figure 4:
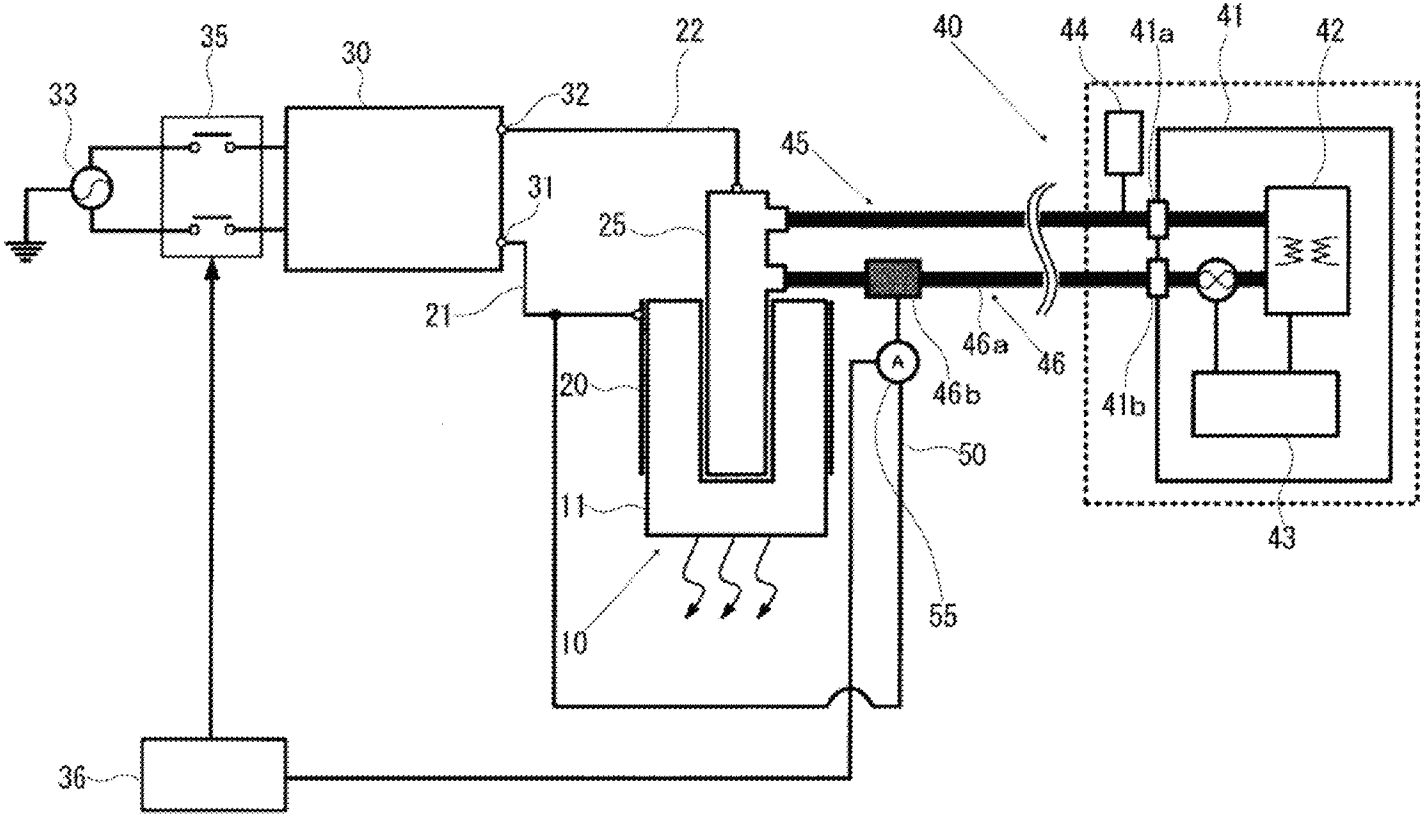
FIG. 4 is an explanatory diagram illustrating a configuration of another example of the light irradiating apparatus according to the example embodiment of the invention.

FIG. 4 is an explanatory diagram illustrating a configuration of another example of the light irradiating apparatus as an embodiment of the invention. In the light irradiating apparatus, the leak current discharge circuit may be configured of the wiring 50 that is electrically connected to the low voltage side terminal 31 in the lamp lighting mechanism 30. Otherwise, the light irradiating apparatus may have a similar configuration to that of the light irradiating apparatus illustrated in FIG. 1.

In the light irradiating apparatus, the conductive tube section 46*b* in the cooling medium retrieval tube 46 is electrically connected to the leak current discharge circuit configured of the wiring 50 that is electrically connected to the low voltage side terminal 31 in the lamp lighting mechanism 30. Therefore, it is possible to allow a current flowing from the high voltage side electrode 25 in the excimer lamp 10 to the cooling medium to be discharged to the low voltage side terminal 31, in a case of the high voltage current leakage from the high voltage side electrode 25 to the cooling medium. Hence, it is possible to cool the high voltage side electrode 25 of the excimer lamp 10 safely.

Moreover, in a case of the excessive current leakage to the cooling medium, the contact of the switch 35 provided between the lamp lighting mechanism 30 and the alternating current power source 33 is opened. This makes it possible to stop the lighting of the excimer lamp 10.

The light irradiating apparatus as an embodiment of the invention is not limited to the above-described example embodiment, but may be modified in a wide variety of ways, as exemplified below.

Figure 5:
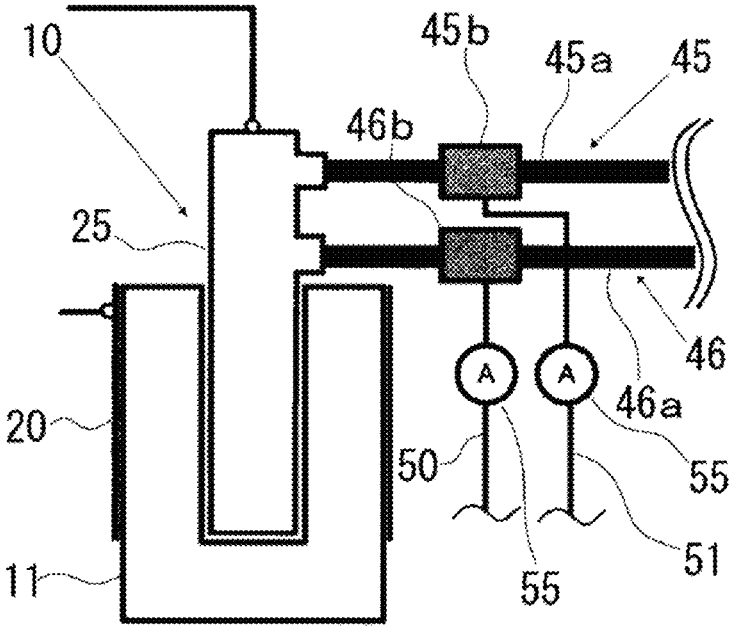
FIG. 5 is an explanatory diagram illustrating a configuration of another example of a cooling medium supply tube.

(1) As illustrated in FIG. 5, the cooling medium supply tube 45 may be configured of two insulating tube sections 45*a* and a conductive tube section 45*b*. The insulating tube sections 45*a* each may be configured of an insulator. The conductive tube section 45*b* may be disposed between the insulating tube sections 45*a* and may be configured of a conductor. The conductive tube section 45*b* may be electrically connected to the leak current discharge circuit. The leak current discharge circuit may be configured of a wiring 51 that may be grounded or electrically connected to the low voltage side terminal 31 in the lamp lighting mechanism 30.

Figure 6:
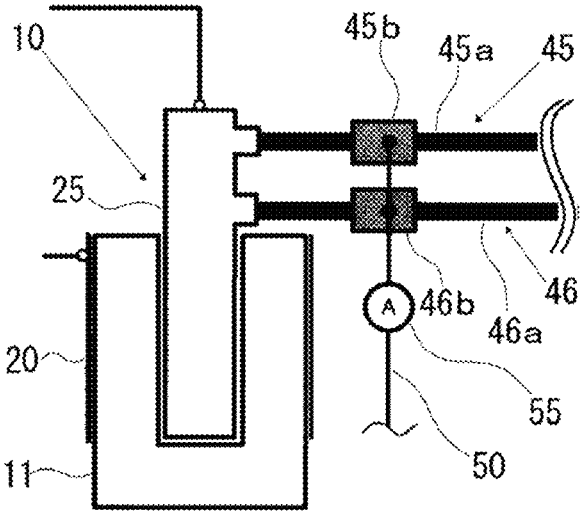
FIG. 6 is an explanatory diagram illustrating a configuration of still another example of the cooling medium supply tube.

(2) As illustrated in FIG. 6, the cooling medium supply tube 45 may be configured of the two insulating tube sections 45*a* and the conductive tube section 45*b*. The insulating tube sections 45*a* each may be configured of an insulator. The conductive tube section 45*b* may be disposed between the insulating tube sections 45*a* and may be configured of a conductor. The conductive tube section 45*b* may be electrically connected to the conductive tube section 46*b* in the cooling medium retrieval tube 46.

(3) The light irradiating apparatus according to an embodiment of the invention may include a plurality of excimer lamps 10.

Figure 7:
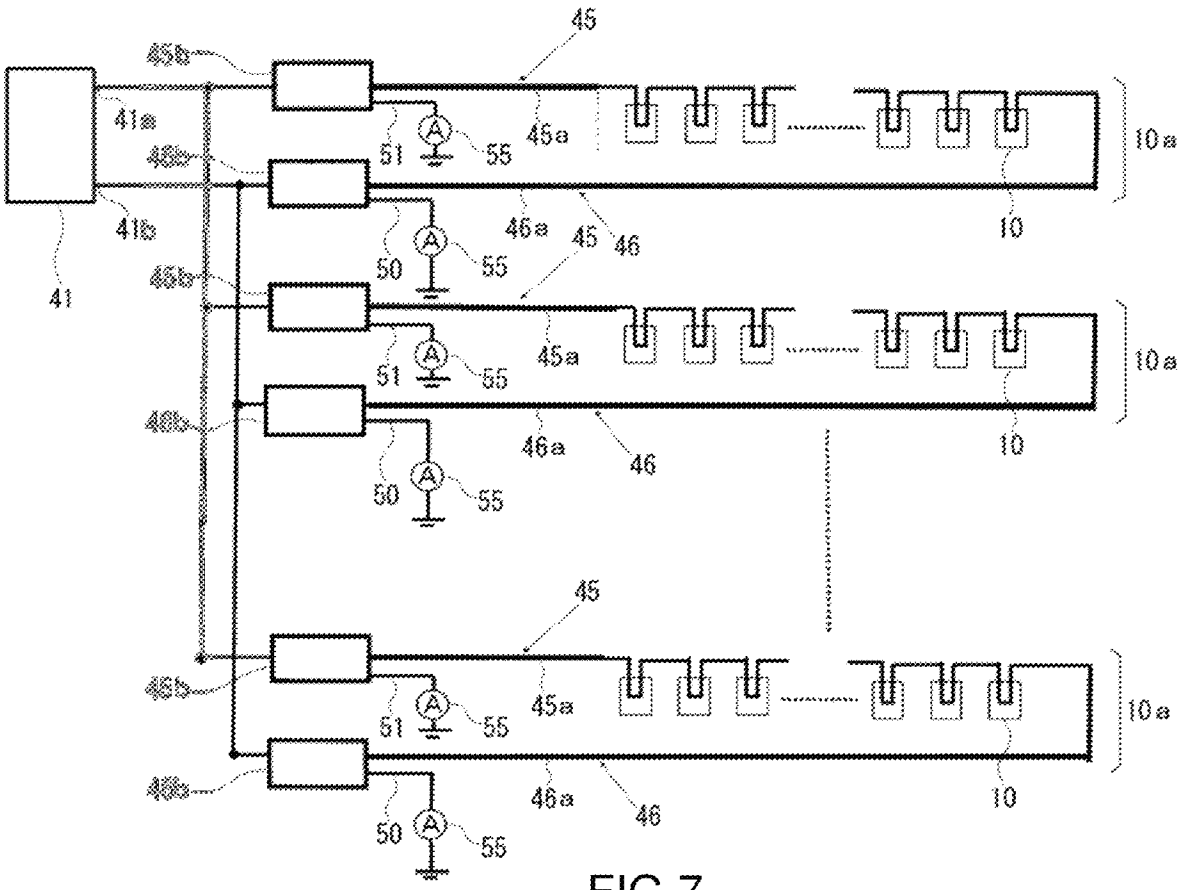
FIG. 7 is an explanatory diagram plan view illustrating a configuration of the cooling medium supply tube and a cooling medium retrieval tube in a case that a plurality of excimer lamps are provided, in the light irradiating apparatus according to the example embodiment of the invention.

FIG. 7 is an explanatory diagram illustrating a configuration of the cooling medium supply tube and the cooling medium retrieval tube in a case with the plurality of excimer lamps. In the light irradiating apparatus, there may be provided a plurality of lamp units 10*a* that each include the plurality of excimer lamps 10. In each of the lamp units 10*a*, the excimer lamps 10 may be connected in series with one another by the cooling medium supply tube 45 and the cooling medium retrieval tube 46. Moreover, the lamp units 10*a* may be connected in parallel with respect to the heat exchanger 41 by the cooling medium supply tube 45 and the cooling medium retrieval tube 46.

In addition, in each of the lamp units 10*a*, the cooling medium supply tube 45 and the cooling medium retrieval tube 46 may be provided with the conductive tube sections 45*b* and 46*b*, respectively. The conductive tube sections 45*b* and 46*b* may be connected to the respective leak current discharge circuits. The leak current discharge circuits may be configured of the grounded wirings 50 and 51. Moreover, the leak current discharge circuits each may be provided with the current detecting section 55 that is configured to detect the current flowing in the leak current discharge circuit. The current detecting section 55 may be electrically connected to the unillustrated switch control section.

(4) In a case of constituting the light irradiating apparatus including the plurality of excimer lamps 10, the configurations of the cooling medium supply tube and the cooling medium retrieval tube are not limited to those illustrated in FIG. 7. For example, all the excimer lamps 10 may be connected in series with one another by the cooling medium supply tube 45 and the cooling medium retrieval tube 46. Alternatively, all the excimer lamps 10 may be connected in parallel with respect to the heat exchanger 41 by the cooling medium supply tube 45 and the cooling medium retrieval tube 46.

Furthermore, the invention encompasses any possible combination of some or all of the various embodiments described herein and incorporated herein.

Although the invention has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially"

and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. A light irradiating apparatus, comprising:

an excimer lamp including a high voltage side electrode and a low voltage side electrode;

a cooling mechanism configured to cool the high voltage side electrode using a cooling medium; and a leak current discharge circuit, wherein the cooling mechanism includes a passage and a conductor, the passage allowing the cooling medium to flow through, and the conductor being in contact with the cooling medium, and the conductor is electrically connected to the leak current discharge circuit.

2. The light irradiating apparatus according to claim 1, wherein part of the passage is configured of the conductor.

3. The light irradiating apparatus according to claim 1, wherein the leak current discharge circuit includes a current detecting section configured to detect a leak current flowing in the leak current discharge circuit.

4. The light irradiating apparatus according to claim 3, further comprising:

a lamp lighting mechanism configured to turn on and turn off the excimer lamp;

a power source configured to supply power to the lamp lighting mechanism;

a switch configured to perform electrical connection and electrical disconnection of the lamp lighting mechanism and the power source; and a control section configured to control operation of the switch in response to the leak current detected by the current detecting section.

5. The light irradiating apparatus according to claim 4, wherein the lamp lighting mechanism includes a first terminal and a second terminal, the first terminal being electrically connected to the high voltage side electrode, and the second terminal being connected to the low voltage side electrode, and the leak current discharge circuit is connected to the second terminal.

6. The light irradiating apparatus according to claim 1, wherein the passage includes a first passage section and a second passage section, the first passage section allowing the cooling medium to flow toward the high voltage side electrode from the cooling mechanism, and the second passage section allowing the cooling medium to flow toward the cooling mechanism from the high voltage side electrode, and the conductor is provided in the second passage section.

* * * * *